United States Patent [19]

Suzuki et al.

[11] 4,448,868

[45] May 15, 1984

[54] ELECTROPHOTOGRAPHIC PHOTORECEPTOR WITH HYDRAZONE DERIVATIVE

[75] Inventors: Shinichi Suzuki; Kiyoshi Sawada, both of Hachioji; Akira Kinoshita; Osamu Sasaki, both of Hino; Satoshi Goto, Hachioji, all of Japan

[73] Assignee: Konishiroku Photo Industry Co., Ltd., Tokyo, Japan

[21] Appl. No.: 463,974

[22] Filed: Feb. 4, 1983

[30] Foreign Application Priority Data

Feb. 5, 1982 [JP] Japan ..... 57/17765
Mar. 27, 1982 [JP] Japan ..... 57/49394

[51] Int. Cl.[3] ..... G03G 5/06; G03G 5/14

[52] U.S. Cl. ..... 430/58; 430/76; 430/78; 430/79; 546/159; 546/162; 548/483; 564/251

[58] Field of Search ..... 430/58, 59, 76, 78, 430/79; 564/251; 542/422; 546/159, 162; 548/483

[56] References Cited

U.S. PATENT DOCUMENTS

| | | | |
|---|---|---|---|
| 4,150,987 | 4/1979 | Anderson et al. | 430/59 X |
| 4,278,747 | 7/1981 | Murayama et al. | 430/59 X |
| 4,385,106 | 5/1983 | Sakai | 430/59 |
| 4,391,889 | 7/1983 | Mabuchi et al. | 430/78 X |
| 4,399,207 | 8/1983 | Sakai et al. | 430/59 X |

FOREIGN PATENT DOCUMENTS

| | | | |
|---|---|---|---|
| 57-58156 | 4/1982 | Japan | 430/59 |

*Primary Examiner*—Roland E. Martin, Jr.
*Attorney, Agent, or Firm*—Jordan B. Bierman; Linda Bierman

[57] ABSTRACT

An electrophotographic photoreceptor having formed on an electrically conductive support a light-sensitive layer containing a hydrazone derivative of formula (I) as a photoconductive material is disclosed:

wherein Z is a divalent hydrocarbon group necessary to form in conjunction with a nitrogen atom a 5- or 6-membered nitrogen-containing heterocyclic ring condensed to the benzene ring; $R_1$ ia an aryl group or a heterocyclic group; $R_2$ is a hydrogen atom, an alkyl group or an aryl group; X is a hydrogen atom, a halogen atom, an alkyl group, a substituted amino group, an alkoxy group or a cyano group; and n is an integer of 0 or 1. This hydrazone derivative exhibits great carrier transporting ability when it is incorporated in the light-sensitive layer.

30 Claims, 7 Drawing Figures

ELECTROPHOTOGRAPHIC PHOTORECEPTOR WITH HYDRAZONE DERIVATIVE

FIELD OF THE INVENTION

The present invention relates to an electrophotographic photoreceptor, and more particularly to a new electrophotographic photoreceptor having a light-sensitive layer containing an organic photoconductive compound.

BACKGROUND OF THE INVENTION

Most of the conventional electrophotographic photoreceptors use a light-sensitive layer containing an inorganic photoconductor such as selenium, zinc oxide, cadmium sulfide or the like as the main component. But none of these photoreceptors have satisfactory heat resistance or durability. Further, great difficulties are met in the manufacture and handling of these photoreceptors due to their toxicity.

Electrophotographic photoreceptors using a light-sensitive layer containing an organic photoconductive compound are also known, and they are getting an increasing amount of researchers' attention these days because they are fairly easy to manufacture, low in production cost, easy to handle, and superior in heat stability to the selenium photoreceptor and the like.

As such organic photoconductive compound, poly-N-vinylcarbazole is well known, and an electrophotographic photoreceptor having a light-sensitive layer that contains as the main component a charge transfer complex formed from the poly-N-vinylcarbazole and a Lewis acid such as 2,4,7-trinitro-9-fluorenone is currently used in industry. A two-layer or dispersed type photoreceptor wherein the carrier generating function and the carrier transporting function are fulfilled by two different materials is known. For example, a product having a light-sensitive layer wherein a carrier generation layer made of a thin amorphous selenium film and a carrier transporting layer made of poly-N-vinyl carbazole are combined is commercially used. But the poly-N-vinyl carbazole is not highly flexible and a coat made of it is rigid and brittle and is highly sensitive to cracking or exfoliation. Therefore, a photoreceptor using this compound does not have great durability. If a plasticizer is added to solve this problem, the residual potential is increased as the photoreceptor is subjected to electrophotographic process, and the accumulated residual potential due to cyclic use causes increased fog in the copied image.

Most organic photoconductive compounds of low molecular weight have no film-forming properties and are used in combination with suitable binders. So they are preferred in that the physical properties of the film and the electrophotographic characteristics of the copy can be controlled to some extent by changing the type of the binder used or its proportion. However, only limited types of organic photoconductive compounds have high miscibility with binders and, in fact, there are not many compounds that can be incorporated in the light-sensitive layer of a photoreceptor.

For instance, U.S. Pat. No. 3,189,447 describes 2,5-bis(p-diethylaminophenyl)-1,3,4-oxadiazole, and this compound has low miscibility with binders conventionally used in the light-sensitive layer of a photoreceptor. When that compound is mixed with a binder such as polyester or polycarbonate in the ratio necessary for producing the desired electrophotographic characteristics, the oxadiazole crystallizes in the light-sensitive layer at 50° C. or higher, with the result that its electrophotorgraphic characteristics such as charge retention and sensitivity are impaired.

U.S. Pat. No. 3,820,989 discloses a diaryl alkane derivative and this compound has no problem with its miscibility with binders. However, the compound has low stability to light, so when it is incorporated in the light-sensitive layer of a photoreceptor for cyclic transfer xerography wherein it is subjected to repeated charging and exposure, the sensitivity of that layer is gradually decreased and the residual potential increased. This means the photoreceptor is inferior in durability. Therefore, the state of the art has no organic photoconductive compound available that has preferred characteristics for use in commercial production of electrophotographic photoreceptors.

SUMMARY OF THE INVENTION

One object of the present invention is to provide an electrophotographic photoreceptor that contains a new organic photoconductive compound which has high miscibility with binders, is stable to both heat and light, and has great carrier transporting ability.

Another object of the invention is to provide an electrophotographic photoreceptor that has high sensitivity with small residual potential.

A further object of the invention is to provide a highly durable electrophotographic photoreceptor that undergoes less fatigue deterioration and exhibits consistent characteristics over an extended period when it is subjected to cyclic operations of charging, exposure, development and transfer.

As a result of various studies to achieve these objects, we have found that the objects can be successfully attained by incorporating a specific hydrazone derivative in the light-sensitive layer of an electrophotographic photoreceptor.

The objects of the present invention can be accomplished by forming on an electrically conductive support a light-sensitive layer containing a hydrazone derivative of formula (I):

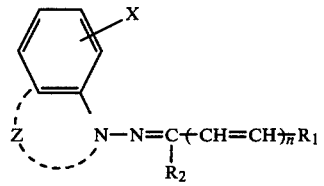

wherein Z is a divalent hydrocarbon group necessary to form in conjunction with a nitrogen atom a 5- or 6-membered nitrogen-containing heterocyclic ring condensed to the benzene ring; $R_1$ is a substituted or unsubstituted aryl group, with phenyl, napthyl and anthryl groups being preferred aryl groups, or a substituted or unsubstituted heterocyclic group, with furyl, thienyl, indolyl, benzofuryl, benzothienyl and carbazolyl groups being preferred heterocyclic groups, illustrative substituents being an alkyl group, an alkoxy group, a substituted amino group such as a dialkylamino, diarylamino or alkylaryamino group, a phenyl group, a naphthyl group, a hydroxy group, and a halogen atom; $R_2$ is a hydrogen atom, a substituted or unsubstituted alkyl, with an alkyl group of 1 to 8 carbon atoms being a preferred alkyl group, or a substituted or unsubstituted aryl group, with a phenyl or naphthyl group being a preferred aryl group, illustrative substituents being an alkyl group, an alkoxy group, a substituted amino group such as a dialkylamino group, diarylamino group or alkylarylamino group, a hydroxyl group and a halogen atom; X is a hydrogen atom, a halogen atom, an alkyl group, an alkoxy group, a cyano group or a substituted amino group such as a dialkylamino group, a diarylamino group or an alkylarylamino group; and n is an integer of 0 or 1.

and

Figure 7:
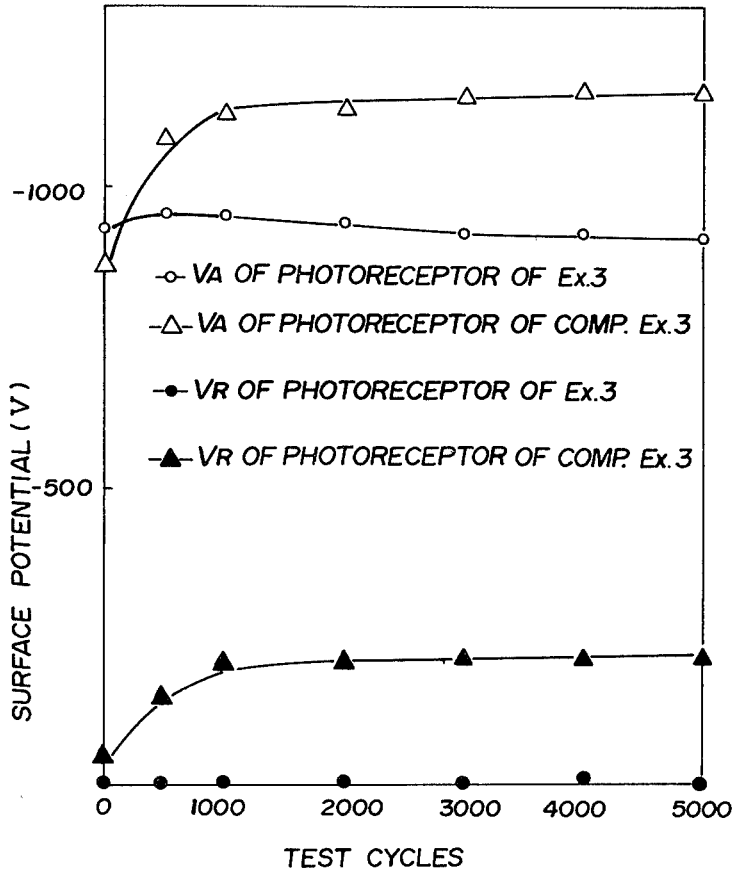

FIG. 7 is a graph showing the residual potential vs. copying times profile of the samples prepared in Example 3 and Comparative Example 3.

DESCRIPTION OF THE PREFERRED EMBODIMENTS

According to the present invention, by using the hydrazone derivative of formula (I) as a photoconductive material that makes up the light-sensitive layer of an electrophotographic photoreceptor, or by using the same as a carrier transporting material in a function-separated photoreceptor, a photoreceptor that has high film-forming properties, has good electrophotographic characteristics such as high charge retention, high sensitivity and low residual potential, undergoes small fatigue deterioration after cyclic use, and exhibits high resistance to both heat and light can be produced. The hydrazone derivatives of formula (I) may be used either individually or in combination, and they may also be used in combination with other photoconductive materials.

Illustrative hydrazone derivatives of formula (I) wherein Z is a divalent hydrocarbon group necessary to form in conjunction with a nitrogen atom a 6-membered nitrogen-containing heterocyclic ring condensed to the benzene ring are listed below, but it should be understood that the hydrazone derivatives used in the present invention are by no means limited to these examples.

Illustrative hydrazone derivatives K

K-(1)

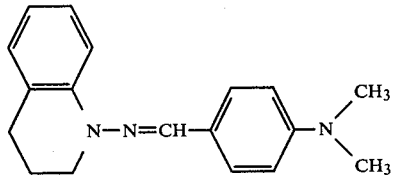

K-(2)

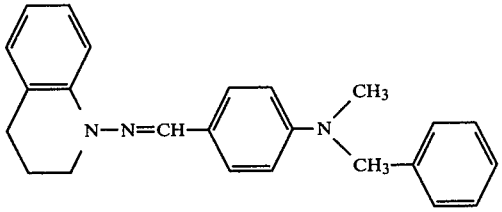

-continued

Illustrative hydrazone derivatives K

K-(3)

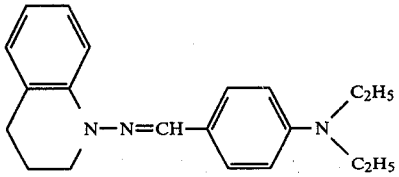

K-(4)

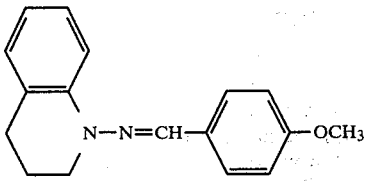

K-(5)

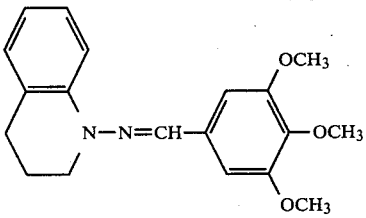

K-(6)

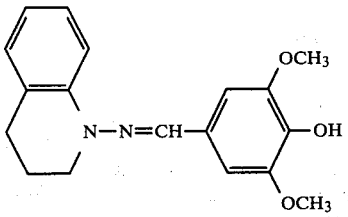

K-(7)

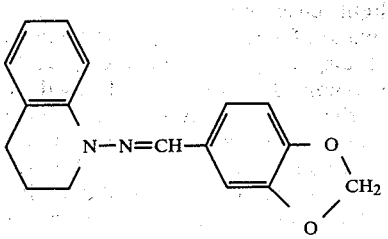

K-(8)

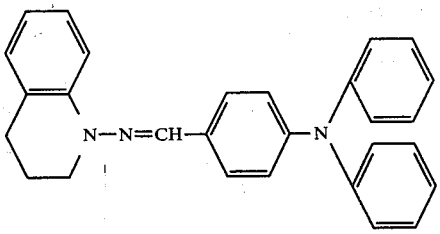

K-(9)

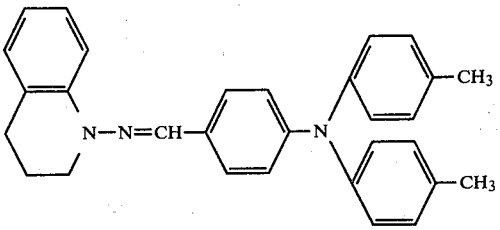

-continued
Illustrative hydrazone derivatives K
K-(10)
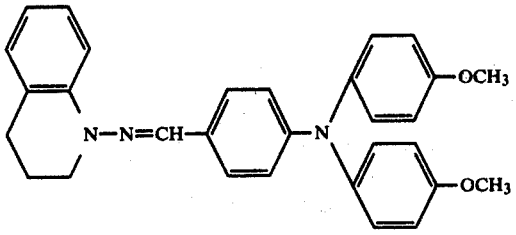
K-(11)
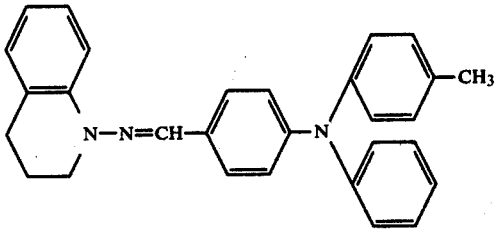
K-(12)
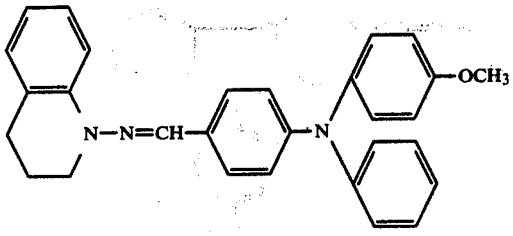
K-(13)
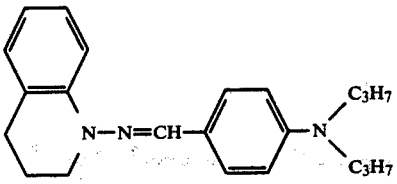
K-(14)
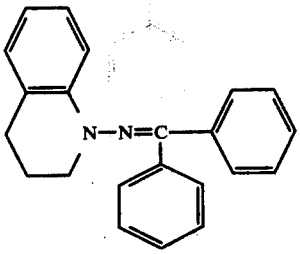
K-(15)
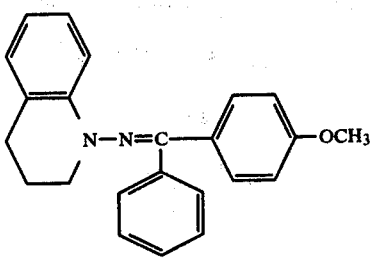
-continued
Illustrative hydrazone derivatives K
K-(16)
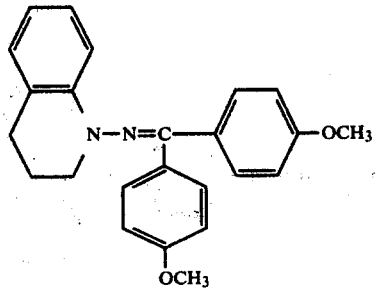
K-(17)
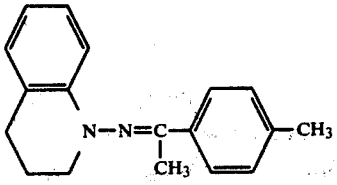
K-(18)
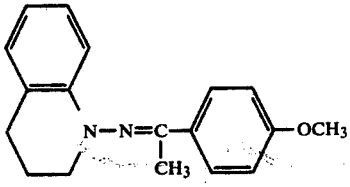
K-(19)
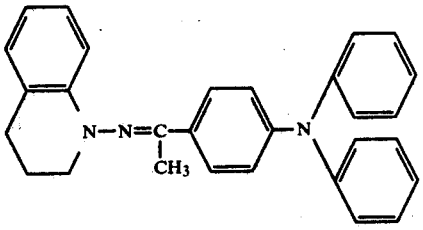
K-(20)
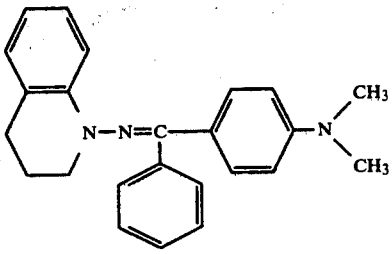
K-(21)
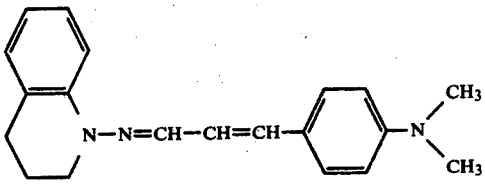

-continued
Illustrative hydrazone derivatives K
K-(22)
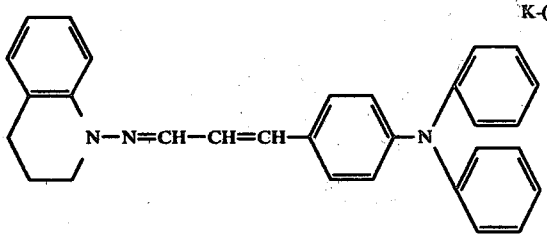
K-(23)
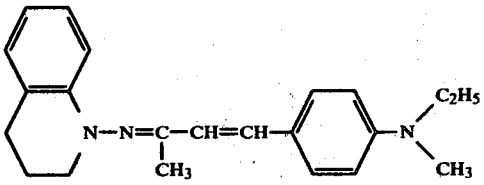
K-(24)
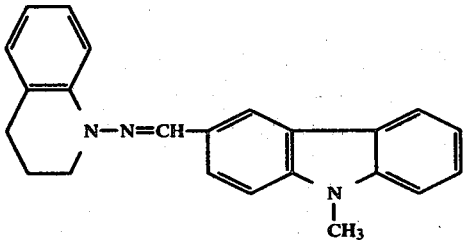
K-(25)
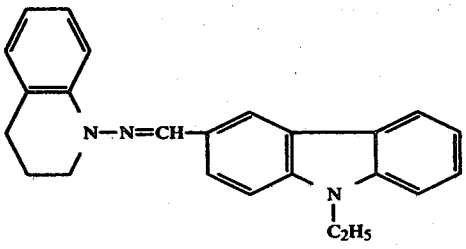
K-(26)
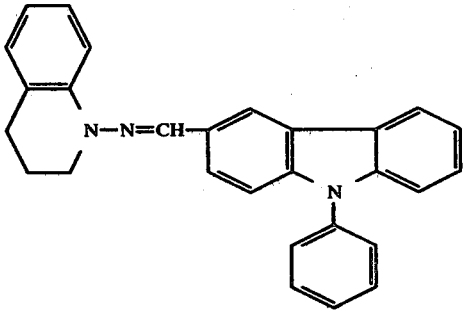
-continued
Illustrative hydrazone derivatives K
K-(27)
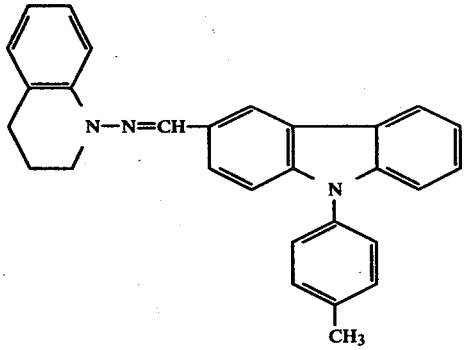
K-(28)
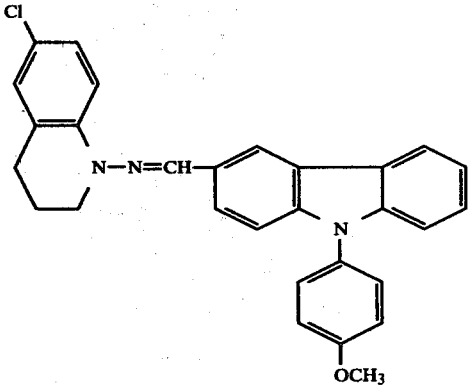
K-(29)
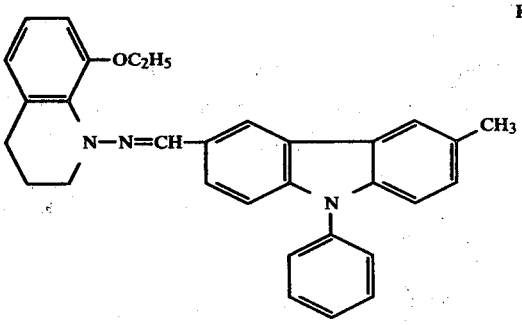
K-(30)
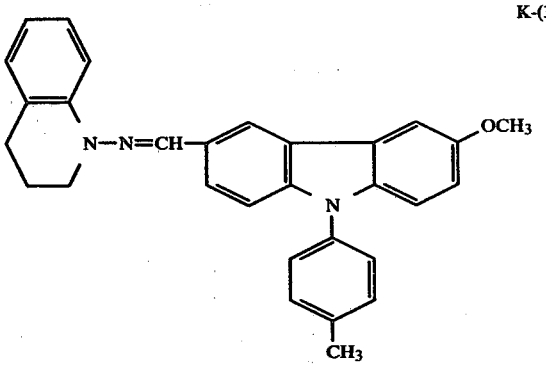

-continued
Illustrative hydrazone derivatives K
K-(31)
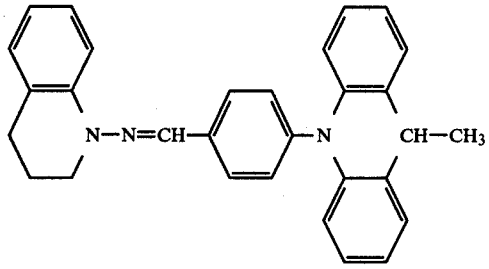
K-(32)
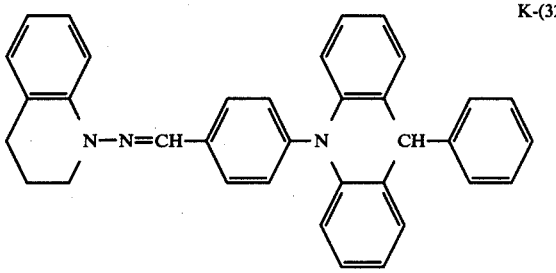
K-(33)
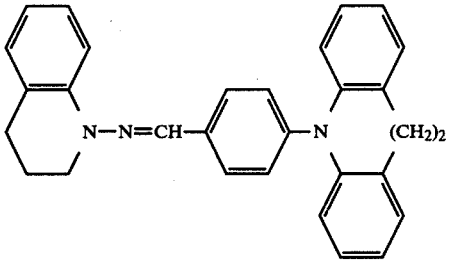
K-(34)
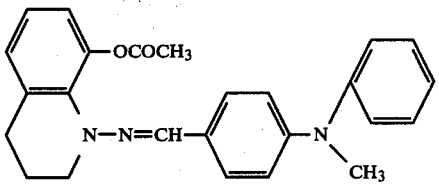
K-(35)
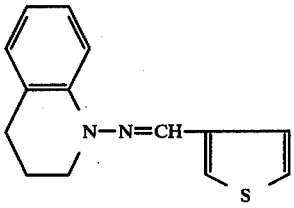
K-(36)
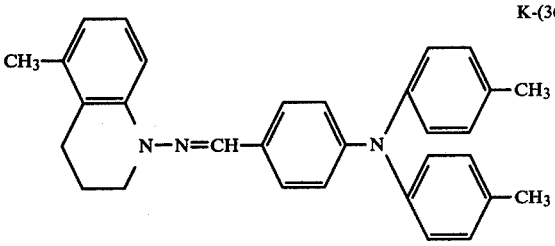
-continued
Illustrative hydrazone derivatives K
K-(37)
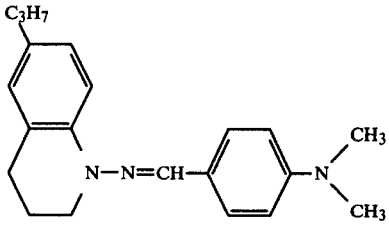
K-(38)
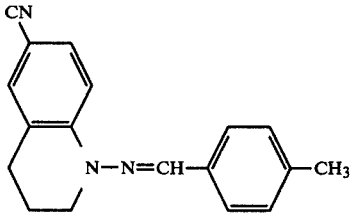
K-(39)
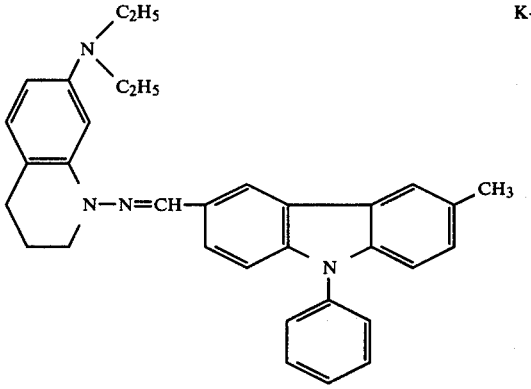
K-(40)
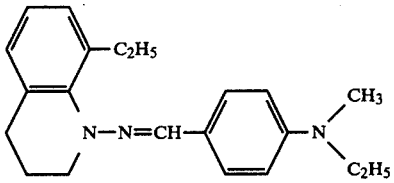
K-(41)
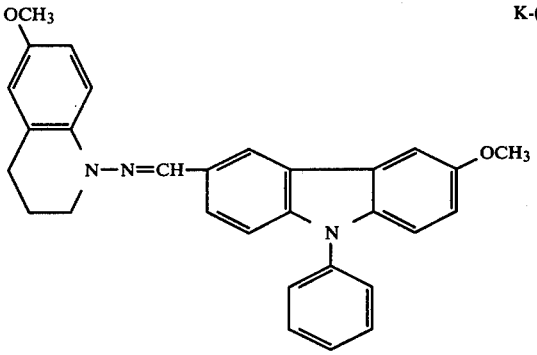
K-(42)
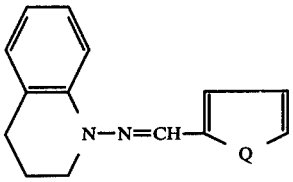

-continued

Illustrative hydrazone derivatives K

K-(43)

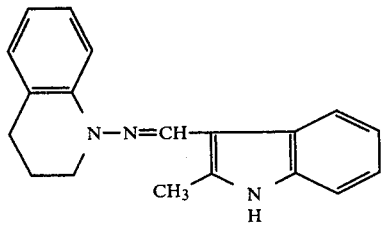

K-(44)

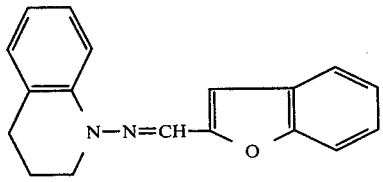

K-(45)

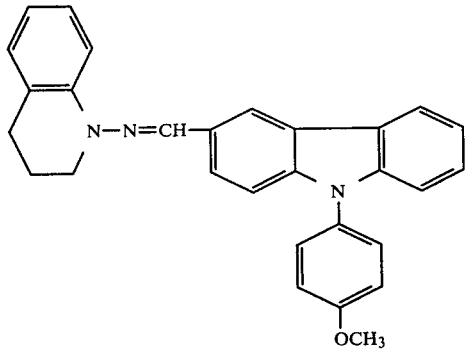

K-(46)

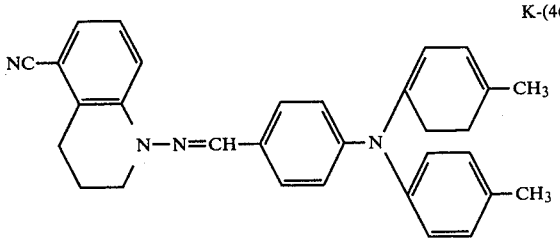

These hydrazone derivatives K can be readily prepared by known methods. For example, 1-amino-1,2,3,4-tetraphydroquinoline derivative of formula (III) and a carbonyl compound of formula (IV) are dehydratively condensed in a solvent such as alcohol optionally in the presence of an acid catalyst to prepare a hydrazone derivative of formula (II). The reaction scheme for this process is shown below:

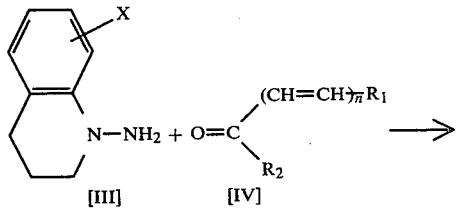

-continued

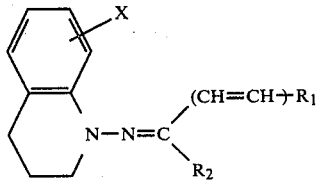

[II]

wherein $R_1$, $R_2$, X and n each has the same meaning as defined in formula (I).

Illustrative hydrazone derivatives of formula (I) wherein Z is a divalent hydrocarbon group necessary to form in conjunction with a nitrogen atom a 5-membered nitrogen-containing heterocyclic ring condensed to the benzene ring are listed below, but it should be understood that the hydrazone derivatives used in the present invention are by no means limited to these examples.

Illustrative hydrazone derivaties L

L-(1)

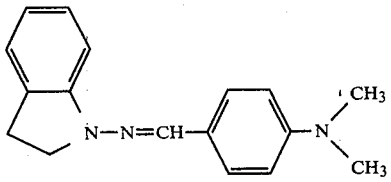

L-(2)

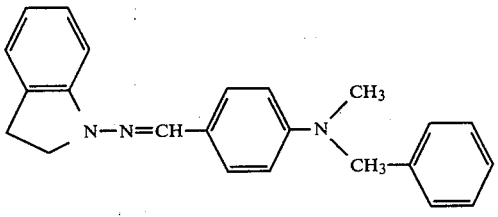

L-(3)

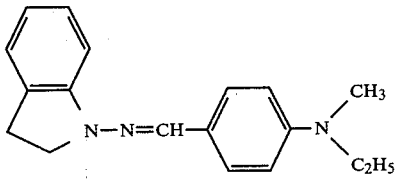

L-(4)

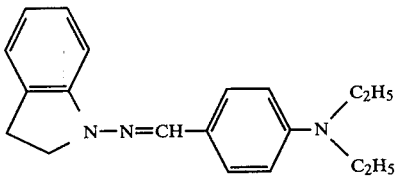

L-(5)

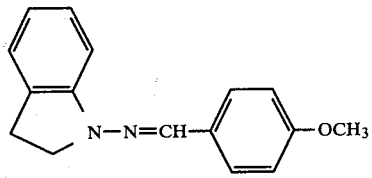

-continued
Illustrative hydrazone derivaties L
L-(6)
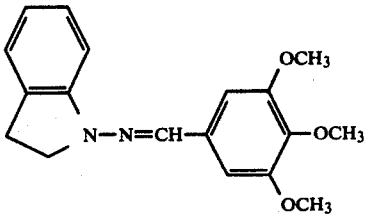
L-(7)
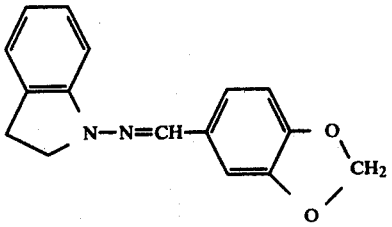
L-(8)
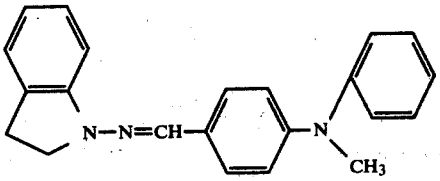
L-(9)
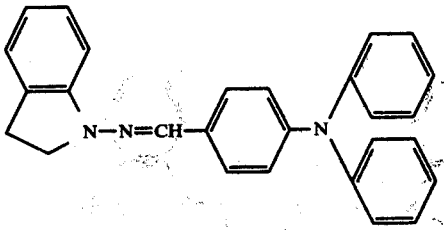
L-(10)
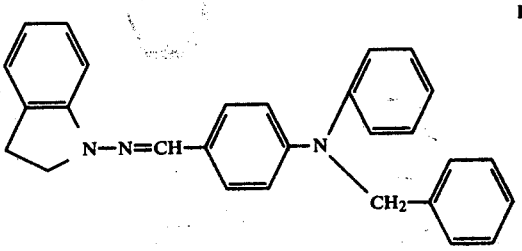
L-(11)
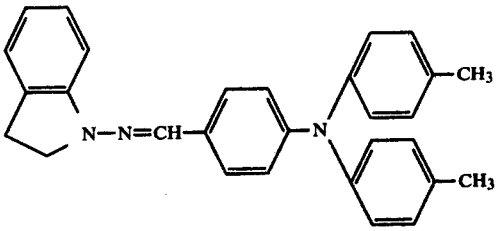
-continued
Illustrative hydrazone derivaties L
L-(12)
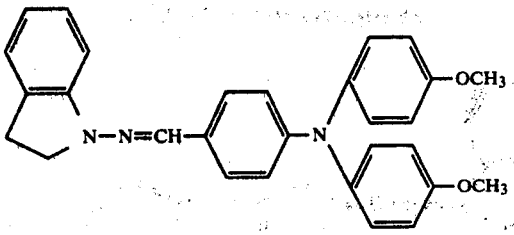
L-(26)
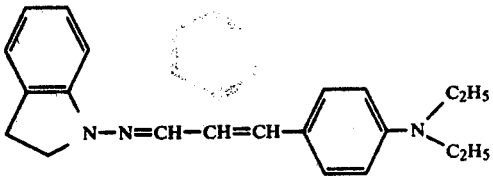
L-(27)
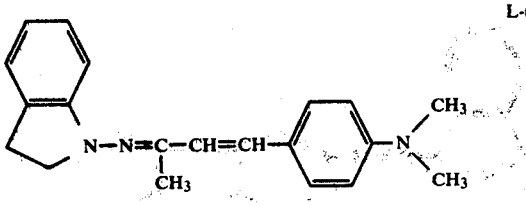
L-(28)
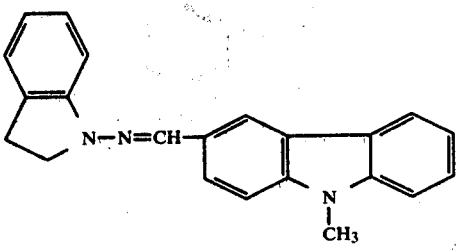
L-(29)
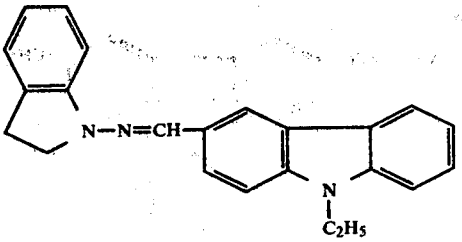
L-(30)
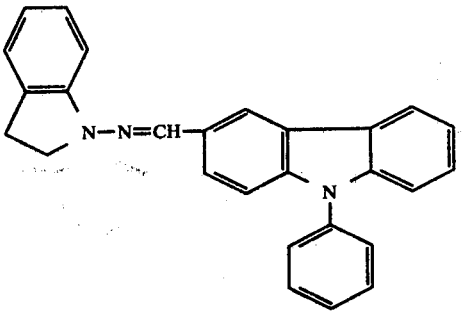

-continued
Illustrative hydrazone derivaties L
L-(31)
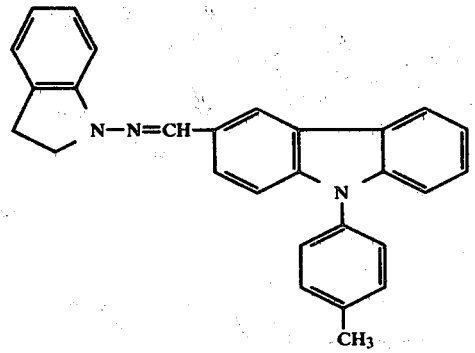
L-(32)
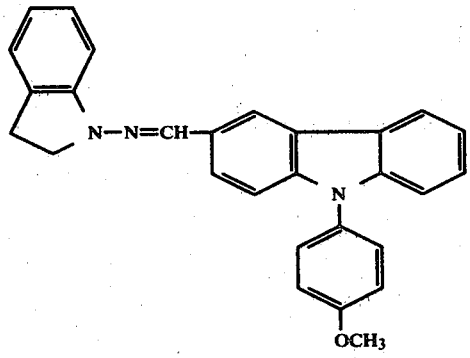
L-(33)
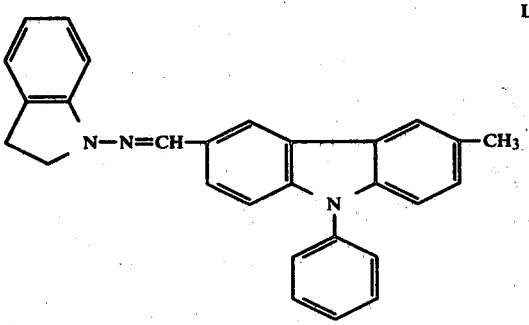
L-(34)
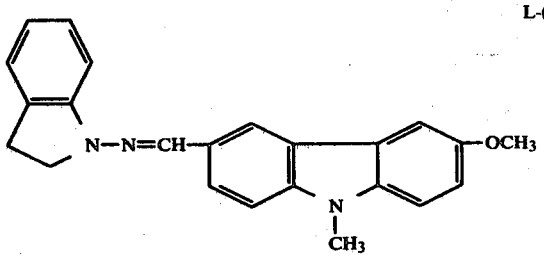
-continued
Illustrative hydrazone derivaties L
L-(35)
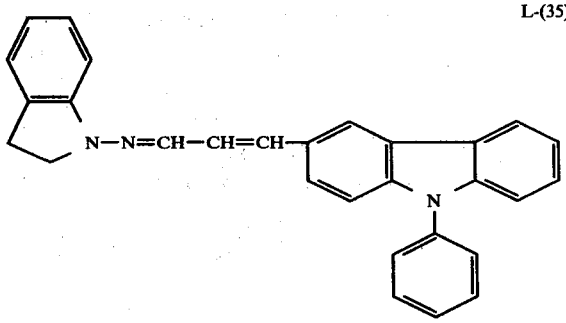
L-(36)
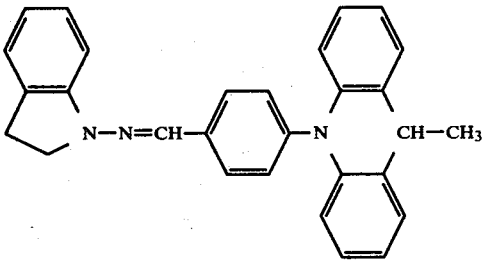
L-(37)
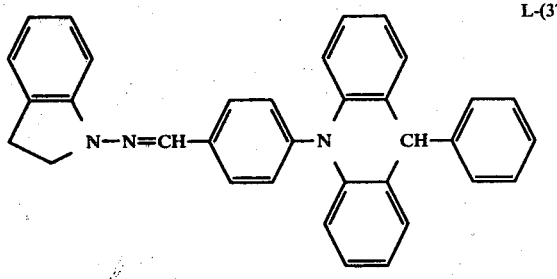
L-(38)
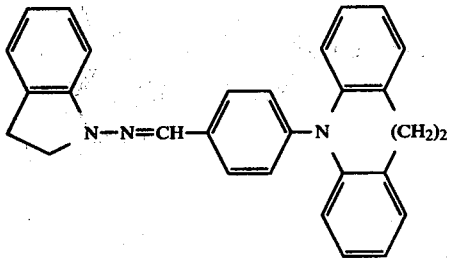
L-(39)
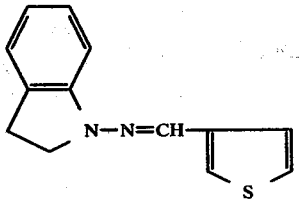
L-(40)
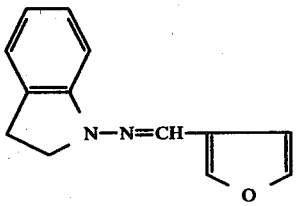

-continued

Illustrative hydrazone derivaties L

L-(41)

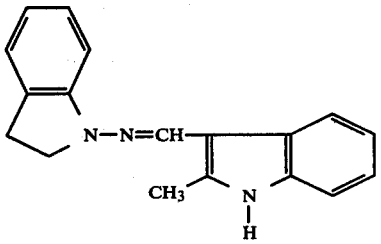

L-(42)

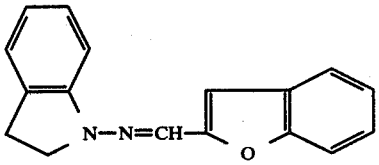

L-(43)

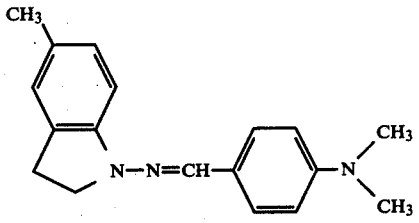

L-(44)

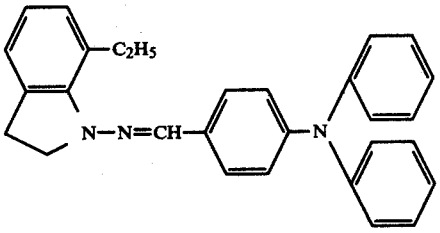

L-(45)

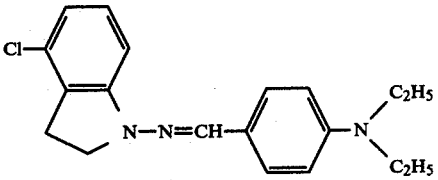

L-(46)

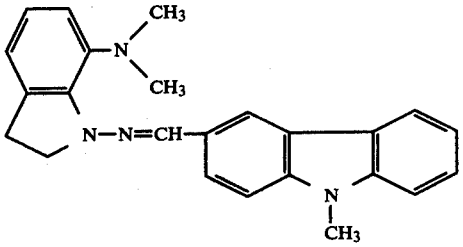

-continued

Illustrative hydrazone derivaties L

L-(47)

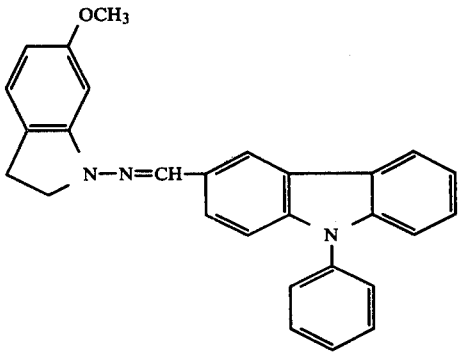

These hydrazone derivatives L can be readily prepared by known methods. For example, 1-aminoindoline derivative of formula (V) and a carbonyl compound of formula (IV) are dehydratively condensed in a solvent such as alcohol optionally in the presence of an acid catalyst to produce a hydrazone derivative of formula (III). The reaction scheme for this process is noted below:

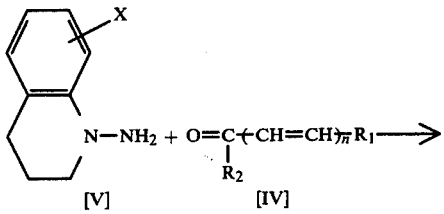

[V] [IV]

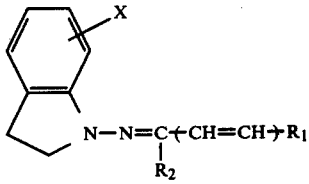

[III]

wherein $R_1$, $R_2$, X and n each has the same meaning as defined in formula (I).

Typical methods of producing five of the hydrazone derivatives of the present invention are described below.

Synthesis of compound K-(3)

A mixture of 1.5 g (0.01 mole) of 1-amino-1,2,3,4-tetrahydroquinoline (Zhur. Obshchei. Khim., 29, 1949–53, 1959) and 1.8 g (0.01 mole) of diethylaminobenzaldehyde was dissolved in ethanol (40 ml). To the resulting solution, acetic acid (5 ml) was added, and the mixture was heated under reflux for one hour. The reaction mixture was left to cool and the resulting crystal was filtered and recrystallized from ethanol to obtain 2.8 g (yield: 93.3%) of the object hydrazone compound having a melting point of 129° to 130° C.

Synthesis of compound K-(9)

A mixture of 1.5 g (0.01 mole) of 1-amino-1,2,3,4-tetraphydroquinoline and 3.0 g (0.01 mole) of p-(N,N-di-p-tolylamino)-benzaldehyde was dissolved in isopropanol (30 ml). To the resulting solution, acetic acid (6 ml) was added, and the mixture was heated under reflux for one hour and a half. The reaction mixture was left to cool and the resulting crystal was filtered and recrystallized from a mixed solvent of toluene-isopropanol to obtain 3.4 g (yield: 79.0%) of the object compound having a melting point of 195° to 196° C.

Synthesis of compound K-(26)

A mixture of 1.5 g (0.01 mole) of 1-amino-1,2,3,4-tetrahydroquinoline and 2.7 g (0.01 mole) of N-phenyl-3-carbazole aldehyde was dissolved in isopropanol (30 ml). To the resulting solution, acetic acid (6 ml) was added, and the mixture was heated under reflux for one hour and a half. The reaction mixture was left to cool and the resulting crystal was filtered and purified by chromatography on silicagel to obtain 2.5 g (yield: 62.5%) of the end compound having a melting point of 84.5° to 86° C.

Synthesis of compound K-(25)

A mixture of 1.5 g (0.01 mole) of 1-amino-1,2,3,4-tetrahydroquinoline and 2.2 g (0.01 mole) of N-ethyl-3-carbazole aldehyde was dissolved in ethanol (50 ml). To the resulting solution, acetic acid (5 ml) was added, and the mixture was heated under reflux for 3 hours. The reaction mixture was left to cool and the resulting crystal was filtered and purified by chromatography on silica gel to obtain 2.8 g (yield: 79.3%) of the end compound having a melting point of 115° to 117° C.

Synthesis of compound L-(4)

A mixture of 1.3 g (0.01 mole) of 1-aminoindoline (Zhur. Obshchei Khim., 29, 3820–5, 1959) and 1.8 g (0.01 mole) of diethylaminobenzaldehyde was dispersed in ethanol (50 ml). To the resulting dispersion, acetic acid (5 ml) was added, and the mixture was heated under reflux for one hour and a half. The reaction mixture was left to cool and the resulting crystal was filtered and recrystallized from ethanol to obtain 2.4 g (yield: 83%) of the end compound having a melting point of 99° to 102° C.

The hydrazone derivatives of the present invention have little or no sensitivity to visible light, so, if visible light is used as an irradiation source for exposure, they must be sensitized. Three methods have been proposed for sensitizing organic photoconductive compounds. The first method is spectral sensitization (dye sensitization) by addition of organic dyes. The second sensitization method depends on the formation of a charge transfer complex. Since the hydrazone derivative of the present invention is an electron donor, it is preferably combined with an electron acceptor. The third method utilizes only the carrier transporting ability of the hydrazone derivative of the present invention, which is combined with a carrier generator such as an organic dye, pigment or inorganic photoconductor to form a function-separated photoreceptor. Equally good results are obtained by these three methods and whichever method that suits the specific object may be used to sensitize the hydrazone derivatives of the present invention.

Typical examples of the organic dye for spectral sensitization are listed below.

| | |
|---|---|
| (A-1) | Triphenylmethane dyes such as Methyl Violet, Crystal Violet and Malachite Green; |

-continued

| | |
|---|---|
| (A-2) | Xanthene dyes such as erythrosin and rose bengal; |
| (A-3) | Thiazine dyes such as methylene blue and methylene green; |
| (A-4) | Oxazine dyes such as Capri Blue and Meldola's Blue; |
| (A-5) | Cyanine dyes such as thiacyanine and oxacyanine; |
| (A-6) | Styryl dyes such as p-dimethylamino styrylquinoline; |
| (A-7) | Pyrylium salt dyes such as pyrylium salt, thiapyrylium salt, benzopyrylium salt and benzothiapyrylium salt; and |
| (A-8) | 3,3'-Dicarbazolyl methane dyes. |

These dyes may be used as carrier generators. Other carrier generators include the following:

| | |
|---|---|
| (B-1) | Azo dyes such as monoazo dyes, bisazo dyes and trisazo dyes; |
| (B-2) | Perylene dyes such as perylenic acid anhydride and imide; |
| (B-3) | Indigo dyes such as indigo and thioindigo; |
| (B-4) | Polycyclic quinones such as anthraquinone, pyrenequinone and flavanthrone; |
| (B-5) | Quinacridone dyes; |
| (B-6) | Bisbenzimidazole dyes; |
| (B-7) | Indanthrone dyes; |
| (B-8) | Squarylium dyes; |
| (B-9) | Phthalocyanine dyes such as metallic and non-metallic phthalocyanines; |
| (B-10) | Selenium and its alloys; |
| (B-11) | Inorganic photoconductors such as CdS, CdSe and amorphous silicon; and |
| (B-12) | Eutectic complexes formed of pyrylium salt or thiapyrylium salt dyes and polycarbonate. |

Examples of the electron acceptor that are capable of forming charge transfer complexes with the hydrazone derivatives of the present invention are Lewis acids such as 2,4,7-trinitrofluorenone, 2,4,5,7-tetranitrofluorenone, chloranil and tetracyanoxydimethane. Chemical sensitizers may also be used effectively in the photoreceptor of the present invention.

The hydrazone derivatives used in the present invention have no ability to form a film by themselves, so they are combined with suitable binders to form a light-sensitive layer. Preferred binders are those high-molecular polymers which are hydrophobic, high in dielectric constant and electrically insulating. These polymers are illustrated by, but are by no means limited to, the following examples:

| | |
|---|---|
| (C-1) | Polycarbonates; |
| (C-2) | Polyesters; |
| (C-3) | Methacrylic resins; |
| (C-4) | Acrylic resins; |
| (C-5) | Polyvinyl chloride; |
| (C-6) | Polyvinylidene chloride; |
| (C-7) | Polystyrene; |
| (C-8) | Polyvinyl acetate; |
| (C-9) | Styrene copolymer resins (e.g. styrene-butadiene copolymer); |
| (C-10) | Acrylonitrile copolymer resins (e.g. vinylidene chloride-acrylonitrile copolymer); |
| (C-11) | Vinyl chloride-vinyl acetate copolymer; |
| (C-12) | Vinyl chloride-vinyl acetate-maleic anhydride copolymer; |
| (C-13) | Silicone resins; |
| (C-14) | Silicone-alkyd resin; |
| (C-15) | Phenolic resins (e.g. phenol-formaldehyde resin and m-cresol-formaldehyde resin); |
| (C-16) | Styrene-alkyd resin; and |
| (C-17) | Poly-N—vinyl carbazole. |

These binders can be used either alone or in combination.

Figure 1:
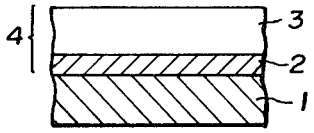
FIGS. 1 to 6 are cross-sectional views of the photoreceptor of the present invention in different embodiments.
Figure 2:
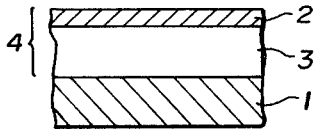
Figure 3:
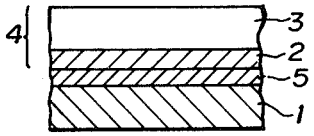
Figure 4:
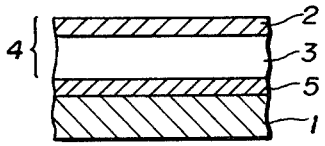
Figure 5:
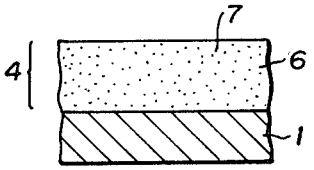
Figure 6:
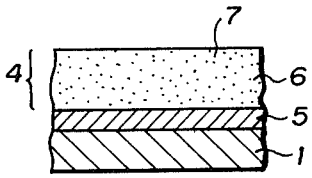

Various layer arrangements of the photoreceptor of the present invention are shown schematically in FIGS. 1 to 6. In FIGS. 1 and 2, an electrically conductive support 1 is coated with a carrier generation layer 2 containing a carrier generator as the main component, which is overlaid with a carrier transporting layer 3 that contains the hydrazone derivative of the present invention as the main component, the two layers 2 and 3 forming a light-sensitive layer 4. As shown in FIGS. 3 and 4, the light-sensitive layer 4 may be formed on the support via an intermediate layer 5. The illustrated double-layer arrangement is most effective in producing a photoreceptor having the desired electrophotographic characteristics. Alternatively, as shown in FIGS. 5 and 6, a light-sensitive layer 4 having fine particles of a carrier generator 7 dispersed in a layer 6 containing the carrier transporting material as the main component is formed on the conductive support 1 either directly or through intermediate layer 5. Good results are also obtained by combining the carrier transporting material with a sensitizing dye or Lewis acid instead of the carrier generator in the single-layer arrangement of light-sensitive layer 4 shown in FIG. 5 or 6.

When the light-sensitive layer 4 is composed of carrier generation layer 2 and carrier transporting layer 3, the former may be disposed on top of the latter, and vice versa, and whichever layer should be disposed on top is determined by the charging polarity. If the light-sensitive layer is to be negatively charged, carrier transporting layer 3 is preferably disposed on top of carrier generation layer 2 because the hydrazone derivative in the carrier transporting layer 3 has great ability to transport positive holes.

The carrier generation layer 2 that forms one of the two layers of the light-sensitive layer 4 is formed on the conductive support 1 or carrier transporting layer 3 either directly or through an intermediate layer such as an adhesive or barrier layer. The layer 2 can be formed by any of the following three methods:

| | |
|---|---|
| (m-1) | Vacuum deposition; |
| (m-2) | A carrier generator is dissolved in a suitable solvent, and the resulting solution is coated onto a selected layer; and |
| (m-3) | The bisazo compound is reduced to fine particles in a dispersion medium by a ball mill or a homomixer either alone or in the presence of a binder, and the resulting solution is coated onto a selected layer. |

The so-prepared carrier generation layer 2 preferably has a thickness of 0.01 to 5 microns, more preferably from 0.05 to 3 microns.

The thickness of carrier transporting layer 3 is variable with the specific need, and usually, a 5 to 30 micron range is preferred. The preferred composition of carrier transporting layer 3 is such that one part by weight of a carrier transporting material that contains the hydrazone derivative of the present invention as the main component is combined with 0.8 to 10 parts by weight of the binder. In case of light-sensitive layer 4 wherein fine particles of a carrier generator are dispersed in the carrier transporting material, one part by weight of the carrier generator is preferably combined with not more than 5 parts by weight of the binder.

Illustrative conductive supports for use in the photoreceptor of the present invention include metal plates, metal drums, as well as paper and plastic films rendered conductive by coating, deposition or lamination with conductive polymers, conductive compounds such as indium oxide and tin oxide, or thin metal layers such as aluminum, palladium or gold. Examples of the intermediate layer 5 (e.g. adhesive or barrier layer) include not only the high-molecular polymers illustrated above for use as binders but also organic high-molecular materials such as polyvinyl alcohol, polyvinyl acetate, ethyl cellulose and carboxymethyl cellulose, as well as aluminum oxide.

Having the configuration described above, the photoreceptor of the present invention, as will be understood from the examples that follow, is superior in electrophotographic characteristics such as charge retention, sensitivity and image formation, and it is a durable photoreceptor that undergoes very small fatigue deterioration when it is subjected to cyclic transfer electrophotographic process.

The present invention is now described in greater detail by reference to the following examples and comparative examples which are given here for illustrative purposes only and are by no means intended to limit the scope of the invention.

EXAMPLES 1 AND 2

Two electrically conductive supports each comprising a polyester film laminated with an aluminum foil were vacuum-deposited with selenium to form carrier generation layers 0.5 micron thick. Six parts by weight of hydrazone compound K-(1) and 10 parts by weight of a polycarbonate resin, "Panlite L-1250" of Teijin Chemicals Ltd. were dissolved in 90 parts by weight of 1,2-dichloroethane (Example 1). Similarly, 6 parts by weight of hydrazone compound L-(1) and 10 parts by weight of "Panlite L-1250" were dissolved in 90 parts by weight of 1,2-dichloroethane (Example 2). The resulting solutions were applied to the carrier generation layers on the respective supports to form carrier transporting layers each having a dry thickness of 11 microns.

The photoreceptor samples (1) and (2) of the present invention thus prepared were subjected to the following sensitivity test with an electrostatic paper analyzer, "Model SP-428" of Kawaguchi Electric Works, Ltd., and their electrophotographic characteristics were evaluated in a dynamic model. The surface of each sample was charged with a charging device at −6 kV for 5 seconds to give a surface potential $V_A$. Then, the sample was irradiated with a tungsten lamp to give a luminosity of 35 lux. The amount of exposure ($E_{\frac{1}{2}}$ in lux·sec) necessary for reducing the initial surface potential $V_A$ by half was measured. After exposure to 30 lux·sec., the residual surface potential $V_R$ was measured. The same test was repeatedly conducted 100 times. The results are shown in Table 1.

Comparative Example 1

A comparative photoreceptor sample was prepared by repeating the procedure of Examples 1 and 2 except that the following hydrazone derivative was used as the carrier transporting material:

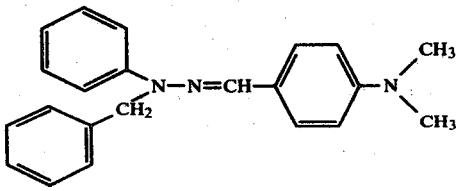

The comparative sample was subjected to the same performance test as in Examples 1 and 2. The results are shown in Table 1.

TABLE 1

| No. of test cycles | Example 1 Photoreceptor sample (1) | | Example 2 Photoreceptor sample (2) | | Comp. Ex. 1 Comparative sample (1) | |
|---|---|---|---|---|---|---|
| | 1 | 100 | 1 | 100 | 1 | 100 |
| $V_A$(V) | −835 | −964 | −854 | −973 | −775 | −945 |
| $E_{\frac{1}{2}}$ (lux.sec) | 7.8 | 8.0 | 8.0 | 8.2 | 8.9 | 10.6 |
| $V_R$(V) | 0 | 0 | 0 | 0 | −5 | −10 |

As is clear from the above data, samples (1) and (2) of the present invention were far superior to comparative sample (1) with respect to sensitivity, residual potential and stability to cyclic operation.

EXAMPLES 3 AND 4

Two electrically conductive supports each comprising a polyester film laminated with an aluminum foil were coated with an intermediate layer 0.05 micron thick made of a vinyl chloride-vinyl acetate-maleic anhydride copolymer ("S-lec MF-10" of Sekisui Chemical Co., Ltd.). On each intermediate layer, dibromoanthanthrone. "Monolight Red 2Y" of I.C.I. Limited (C.I. No. 59300), was vacuum-deposited to form a carrier generation layer 0.5 micron thick. Six parts by weight of hydrazone compound K-(4) and 10 parts by weight of "Panlite L-1250" were dissolved in 90 parts by weight of 1,2-dichloroethane (Example 3). Similarly, 6 parts by weight of hydrazone compound L-(5) and 10 parts by weight of "Panlite L-1250" were dissolved in 90 parts by weight of 1,2-dichloroethane (Example 4). The resulting solutions were applied to the respective carrier generation layers to form carrier transporting layers each having a dry thickness of 11 microns. The photoreceptor samples (3) and (4) of the present invention thus prepared were subjected to the same performance test as in Examples 1 and 2, and the results are shown in Table 2.

Comparative Example 2

A comparative photoreceptor sample was prepared by repeating the procedure of Examples 3 and 4 except that the following hydrazone derivative was used as the carrier transporting material.

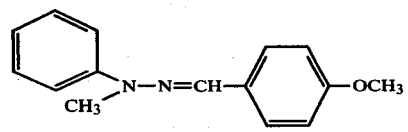

This comparative sample was subjected to the same performance test as in Examples 3 and 4. The results are shown in Table 2.

TABLE 2

| No. of test cycles | Example 3 Photoreceptor sample (3) | | Example 4 Photoreceptor sample (4) | | Comp. Ex. 2 Comparative sample (2) | |
|---|---|---|---|---|---|---|
| | 1 | 100 | 1 | 100 | 1 | 100 |
| $V_A$(V) | −920 | −885 | −840 | −793 | −845 | −1025 |
| $E_{\frac{1}{2}}$ (lux.sec) | 2.7 | 2.5 | 2.5 | 2.4 | 6.4 | 7.9 |
| $V_R$(V) | 0 | 0 | 0 | 0 | −15 | −60 |

As is clear from the above data, samples (3) and (4) of the present invention were far superior to comparative sample (2) with respect to sensitivity, residual potential and stability to cyclic operation.

EXAMPLES 5 AND 6

One part by weight of a bisazo pigment having the structure indicated below was dissolved in 140 parts by weight of a 1.2:1.0:2.2 mixture of ethylenediamine, n-butylamine and tetrahydrofuran, and the solution was applied to each of two conductive supports with an intermediate layer which were the same as used in Examples 3 and 4. The thus-formed carrier generation layers each had a dry thickness of 0.3 micron.

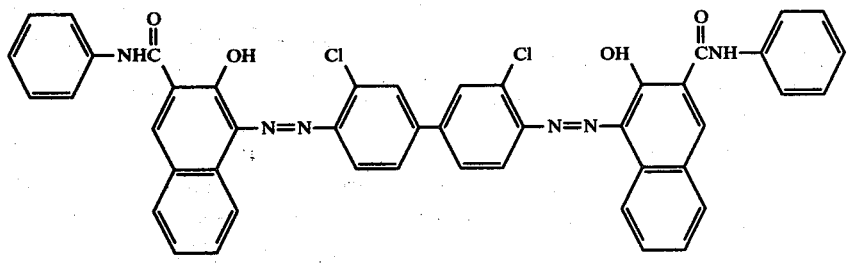

Six parts by weight of hydrazone compound K-(3) and 10 parts by weight of a polycarbonate resin, "Jupilon S-1000" of Mitsubishi Gas Chemical Company Inc., were dissolved in 90 parts by weight of 1,2-dichloroethane (Example 5). Similarly, 6 parts by weight of hydrazone compound L-(4) and 10 parts by weight of "Jupilon S-1000" were dissolved in 90 parts by weight of 1,2-dichloroethane (Example 6). The resulting solutions were applied to the respective carrier generation layers to form carrier transporting layers each having a dry thickness of 13 microns. The photoreceptor samples (5) and (6) of the present invention thus prepared were subjected to the same performance test as in Examples 1 and 2, and the results are shown in Table 3. The same test were repeatedly conducted 5,000 times, and the resulting profile of $V_A$ and $V_R$ of Example 6 is graphed in FIG. 7.

Comparative Example 3

A comparative photoreceptor sample was prepared by repeating the procedure of Examples 5 and 6 except that the following hydrazone derivative was used as the carrier transporting material.

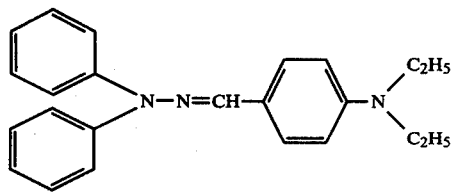

This comparative sample was subjected to the same performance test as in Examples 5 and 6. The results are shown in Table 3 and FIG. 7.

TABLE 3

| No. of test cycles | Example 5 Photoreceptor sample (5) 1 | 100 | Example 6 Photoreceptor sample (6) 1 | 100 | Comp. Ex. 3 Comparative sample (3) 1 | 100 |
|---|---|---|---|---|---|---|
| $V_A$(V) | −980 | −1010 | −925 | −950 | −924 | −1035 |
| $E_{\frac{1}{2}}$ (lux.sec) | 2.2 | 2.3 | 2.3 | 2.4 | 2.5 | 3.0 |
| $V_R$(V) | 0 | 0 | 0 | 0 | −5 | −40 |

As is clear from the above data, samples (5) and (6) of the present invention were far superior to comparative sample (3) with respect to the stability of residual potential against cyclic operation.

K-(8), K-(14), K-(21), K-(27), K-(36), K-(42), L-(9), L-(11), L-(14), L-(32), L-(39) and L-(43) were used respectively as the carrier transporting material. The performance characteristic of the respective samples are shown in Table 4.

TABLE 4

| Ex. No. | Hydrazone compound | $V_A$ (V) | $E_{\frac{1}{2}}$ (lux.sec) | $V_R$ (V) |
|---|---|---|---|---|
| 9 | K-(8) | −920 | 2.3 | 0 |
| 10 | K-(14) | −890 | 2.2 | 0 |
| 11 | K-(21) | −975 | 2.2 | 0 |
| 12 | K-(27) | −985 | 2.4 | 0 |
| 13 | K-(36) | −925 | 2.5 | −2 |
| 14 | K-(42) | −940 | 2.3 | 0 |
| 15 | L-(9) | −905 | 2.3 | 0 |
| 16 | L-(11) | −878 | 2.2 | 0 |
| 17 | L-(14) | −960 | 2.3 | 0 |
| 18 | L-(32) | −951 | 2.5 | 0 |
| 19 | L-(39) | −910 | 2.6 | −5 |
| 20 | L-(43) | −890 | 2.4 | 0 |

The data shows the high cahrge retention (initial potential), high sensitivity and low residual potential of the photoreceptor samples of the present invention.

EXAMPLES 21 AND 22

Two polyester films each having an aluminum vapor-deposited layer were coated with an intermediate layer of polyester, "Vylon-200" of Toyobo Co., Ltd., in a thickness of 0.5 micron. A dispersion of 1 part by weight of a bisazo pigment of the structure indicated below and 1 part by weight of "Panlite L-1250" in 140 parts by weight of 1,2-dichloroethane was applied onto the intermediate on each layer support to form a carrier generation layer in a dry thickness of 1 micron:

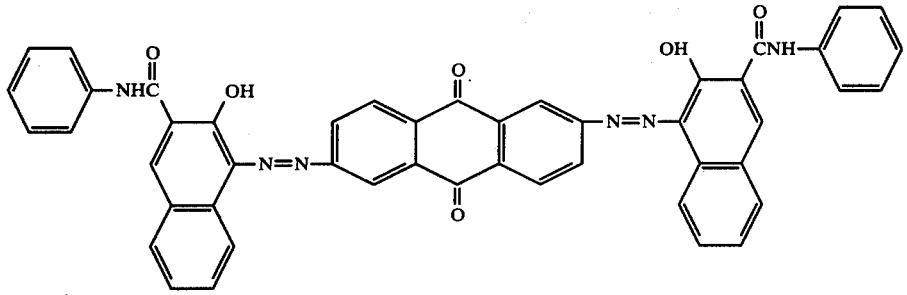

EXAMPLES 7 AND 8

Photoreceptor samples (5) and (6) of the present invention were subjected to a copying test with an electrophotographic copier, "U-Bix 2000R" of Konishiroku Photo Industry Co., Ltd. A sharp fogless copy with faithful and high-contrast image of good tone was produced. The same results were obtained even after 10,000 copies were made.

Comparative Example 4

Comparative sample (3) was subjected to a copying test as in Examples 7 and 8. Initially, sharp images were obtained. but after 500 copies were made, fog became noticeable, and the 1,000th copy no longer had a sharp image. This indicates the very poor performance of comparative sample (3).

EXAMPLES 9 TO 20

Twelve photoreceptor samples were prepared as in Examples 5 and 6 except that hydrazone compounds Then, 6 parts by weight of hydrazone compound K-(25) as a carrier transporting material and 10 parts by weight of a methacrylate resin, "Acrypet" of Mitsubishi Rayon Co., Ltd., were dissolved in 90 parts by weight of 1,2-dichloroethane (Example 21). Similarly, 6 parts by weight of hydrazone compound L-(29) and 10 parts by weight of "Acrypet" were dissolved in 90 parts by weight of 1,2-dichloroethane (Example 22). The resulting solutions were applied to the respective carrier generation layers to form carrier transporting layers each having a dry thickness of 12 microns.

The so-prepared photoreceptor samples were subjected to the same test as in Examples 1 and 2. The results are shown in Table 5. They were set in "U-Bix"2000R and subjected to a copying test consisting of 10,000 cycles of charging, exposure and cleaning operations. The fatigue deterioration due to charging and exposure was checked by measuring the initial potential, sensitivity and residual potential. The results are also shown in Table 5.

Comparative Example 5

A comparative photoreceptor sample was prepared by repeating the procedure of Examples 21 and 22 except that the following hydrazone derivative was used as the carrier transporting material.

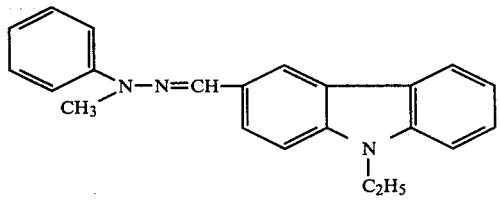

The comparative sample was subjected to the same performance test as in Examples 21 and 22. The results are shown in Table 5.

TABLE 5

| No. of test cycles | Example 21 compound K-(25) 1 | 100 | 10,000 | Example 22 compound L-(29) 1 | 100 | 10,000 | Comp. Ex. 5 1 | 100 | 10,000 |
|---|---|---|---|---|---|---|---|---|---|
| $V_A$(V) | −905 | −920 | −980 | −880 | −904 | −966 | −975 | −1090 | −1160 |
| $E_{\frac{1}{2}}$ (lux.sec) | 2.3 | 2.4 | 2.8 | 2.3 | 2.5 | 2.7 | 2.5 | 3.0 | 9.8 |
| $E_R$(V) | 0 | 0 | −15 | 0 | 0 | −8 | 0 | −18 | −170 |

As is clear from the above data, the samples of Examples 21 and 22 according to the present invention were far superior to the sample of Comparative Example 5 with respect to sensitivity, residual potential and stability to cyclic operation.

EXAMPLES 23 AND 24

One part by weight of a bisazo compound having the structure indicated below was thoroughly dispersed in 140 parts by weight of 1,2-dichloroethane:

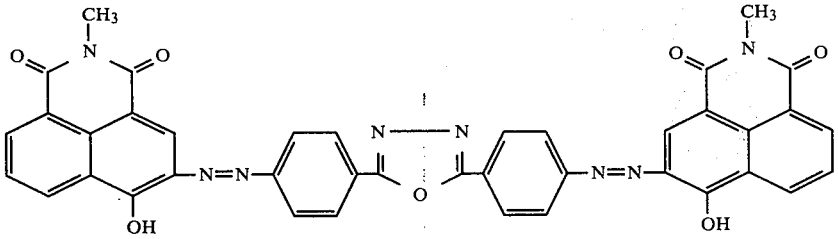

The resulting dispersion was applied to two polyester films each having an aluminum vapor-deposited film. The resulting carrier generation layers each had a dry thickness of 0.4 micron.

Six parts by weight of hydrazone compound K-(26) and 10 parts by weight of "Vylon-200" were dissolved in 90 parts by weight of 1,2-dichloroethane (Example 23). Similarly, 6 parts by weight of hydrazone compound L-(29) and 10 parts by weight of "Vylon-200" were dissolved in 90 parts by weight of 1,2-dichloroethane (Example 24). The resulting solutions were applied to the respective carrier generation layers to form carrier transporting layers each having a dry thickness of 12 microns. The so-prepared photoreceptors had a sensitivity ($E_{\frac{1}{2}}$) of 2.8 lux·sec and a residual potential ($V_R$) of 0 volt. They were irradiated with an ultrahigh-pressure mercury lamp "SHL-100 U,V" of Tokyo Shibaura Electric Co., Ltd. for 10 minutes. The sensitivity and the residual potential were 3.1 lux·sec and 0 volt, respectively, which were little different from the intitial characteristics.

Comparative Example 6

A comparative photoreceptor sample was prepared by repeating the procedure of Examples 23 and 24 except that a hydrazone derivative of the following structure was used as the carrier transporting material:

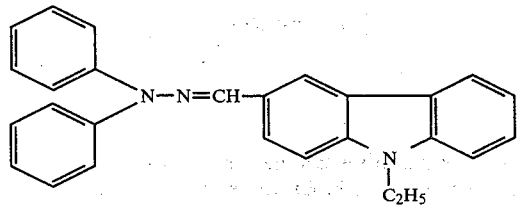

This sample had a sensitivity ($E_{\frac{1}{2}}$) of 4.4 lux·sec and a residual potential ($V_R$) of −30 volts. When it was irradiated with ultra-violet rays as the Examples 23 and 24, the respective values increased to 8.2 lux·sec and −85 volts. This data shows that the comparative sample was very unstable to light in comparison which the samples of Examples 23 and 24.

EXAMPLES 25 AND 26

Two polyester films each having an aluminum vapoer-deposited film were vacuum-deposited with a carrier generation layer (0.5 micron thick) of a perylene pigment having the following structure:

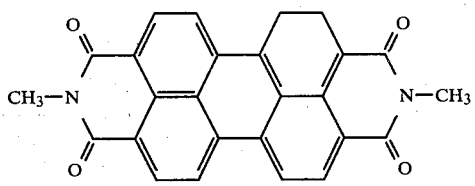

Six parts by weight of hydrazone compound K-(22) and 10 parts by weight of "Vylon-200" were dissolved in 90 parts by weight of 1,2-dichloroethane (Example 25). Similarly, 6 parts of hydrazone compound L-(23)

and 10 parts by weight of "Vylon-200" were dissolved in 90 parts by weight of 1,2-dichloroethane (Example 26). The resulting solutions were applied to the respective carrier generation layers to form carrier transporting layers each having a dry thickness of 15 microns.

The initial characteristic of the two photoreceptor samples were measured as in Examples 1 and 2. The sample of Example 25 using K-(22) as a carrier transporting material had an initial potential ($V_A$) of −1245 volts, a sensitivity ($E_{\frac{1}{2}}$) of 3.9 lux·sec and a residual potential ($V_R$) of −5 volts, and the respective values for the sample of Example 26 using L-(23) were −1190 volts, 3.8 lux·sec and −3 volts.

The samples were left to cool in a constant temperature bath (70° C.) for 10 hours, and their characteristics were measured: the values for the sample of Example 25 were VA=−1210 volts, $E_{\frac{1}{2}}$=4.0 lux·sec and $V_R$=−5 volts, and those for the sample of Example 26 were −1190 volts, 3.8 lux·sec and −3 volts. Apparently, both samples of the present invention had high heat resistance because when they were left in a hot atmosphere, the carrier transporting materials did not crystallize and there was minimum change in the characteristics of the samples.

Comparative Example 7

A comparative photoreceptor sample was prepared by repeating the procedure of Examples 25 and 26 except that the following oxadiazole derivative was used as the carrier transporting material:

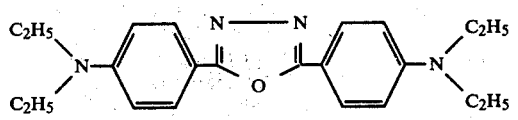

The initial characteristics of the comparative sample were $V_A$=−1325 volts, $E_{\frac{1}{2}}$=4.5 lux·sec and $V_R$=−10 volts. Upon exposure to elevated temperatures, the oxadiazole crystallized on the carrier transporting layer and the sample became no longer usable as an electrophotographic photoreceptor.

EXAMPLES 27 AND 28

Two conductive supports each comprising a polyester film laminated with an aluminum foil were coated with an intermediate layer of "Vylon-200" in a thickness of 0.1 micron. One part by weight of 4-(p-dimethylaminophenyl)-2,6-diphenylthiopyrylium perchlorate, 10 parts by weight of "Jupilon S-1000" and 6 parts by weight of hydrazone compound K-(3) (Example 27) or compound L-(4) (Example 28) were dissolved in 130 parts by weight of dichloromethane under thorough agitation. The resulting solutions were applied to the respective intermediate layers to form light-sensitive layers each having a dry thickness of 12 microns.

The so-prepared photoreceptor samples were subjected to the same performance test as in Examples 1 and 2. The results are shown in Table 6.

TABLE 6

| No. of test | Example 27 (compound K-(3)) | | Example 28 (compound L-(4)) | |
|---|---|---|---|---|
| cycles | 1 | 100 | 1 | 100 |
| $V_A$(V) | −936 | −959 | −878 | −903 |
| $E_{\frac{1}{2}}$ (lux.sec) | 1.7 | 1.9 | 1.9 | 2.0 |

TABLE 6-continued

| No. of test | Example 27 (compound K-(3)) | | Example 28 (compound L-(4)) | |
|---|---|---|---|---|
| cycles | 1 | 100 | 1 | 100 |
| $V_R$(V) | 0 | 0 | 0 | 0 |

The above data shows that the photoreceptors of Examples 27 and 28 according to the present invention had very good characteristics with respect to charge retention, sensitivity and residual potential, as well as very high stability against cyclic operation.

What is claimed is:

1. An electrophotographic photoreceptor having formed on an electrically conductive support a light-sensitive layer containing a hydrazone derivative of formula (I):

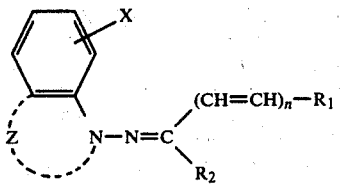

(I)

wherein Z is a divalent hydrocarbon group necessary to form in conjunction with a nitrogen atom a 5- or 6-membered nitrogen-containing heterocyclic ring condensed to the benzene ring; $R_1$ is an aryl group or a heterocyclic group; $R_2$ is a hydrogen atom, an alkyl group or an aryl group; X is a hydrogen atom, a halogen atom, an alkyl group, a substituted amino group, an alkoxy group or a cyano group; and n is an integer of 0 or 1.

2. A photoreceptor according to claim 1, wherein said hydrazone derivative is a compound having the following formula (II):

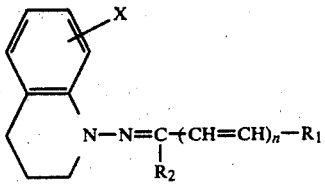

(II)

wherein $R_1$, $R_2$, X and n each has the same meaning as defined in formula (I).

3. A photoreceptor according to claim 1, wherein said hydrazone derivative is a compound having the following formula (III):

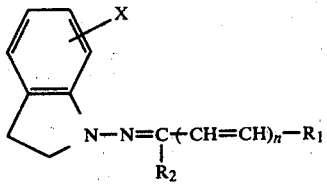

(III)

wherein $R_1$, $R_2$, X and n each has the same meaning as defined in formula (I).

4. A photoreceptor according to claim 1, which is of a function-separated type wherein the light-sensitive layer on the electrically conductive support contains both a carrier generating material and a carrier transporting material.

5. A photoreceptor according to claim 1, wherein said light-sensitive layer is an assembly of a carrier generation layer and a carrier transporting layer.

6. A photoreceptor according to claim 1, wherein said light-sensitive layer has a carrier generating material dispersed in a carrier transporting layer.

7. A photoreceptor according to claim 1, wherein $R_1$ in formula (I) is an aryl group selected from the group consisting of a phenyl, naphthyl and anthryl group, a heterocyclic group selected from the group consisting of a furyl, thienyl, indolyl, benzofuryl, benzothienyl and carbazolyl group, each of said aryl and heterocyclic groups being optionally substituted by a substituent selected from the group consisting of an alkyl group, an alkoxy group, a substituted amino group selected from the group consisting of a dialkylamino, diarylamino and alkylarylamino group, a phenyl group, a naphthyl group, a hydroxyl group and a halogen atom.

8. A photoreceptor according to claim 1, wherein $R_2$ in formula (I) is a hydrogen atom, an alkyl group, preferably having 1 to 8 carbon atoms, or an aryl group such as a phenyl or naphthyl group, each of said alkyl and aryl groups being optionally substituted by a substituent selected from the group consisting of an alkyl group, an alkoxy group, a substituted amino group selected from the group consisting of a dialkylamino, diarylamino and alkylarylamino group, a hydroxyl group and a halogen atom.

9. A photoreceptor according to claim 4, wherein one part by weight of said carrier transporting material is combined with 0.8 to 10 parts by weight of a binder.

10. A photoreceptor according to claim 6, wherein one part by weight of said carrier generating material is combined with not more than 5 parts by weight of a binder.

11. A photoreceptor according to claim 5, wherein the carrier generation layer is positioned closes to the support than the carrier transporting layer is.

12. A photoreceptor according to claim 12, which is of a function-separated type wherein the light-sensitive layer on the electrically conductive support contains both a carrier generating material and a carrier transporting material.

13. A photoreceptor according to claim 3, which is of a function-separated type wherein the light-sensitive layer on the electrically conductive support contains both a carrier generating material and a carrier transporting material.

14. A photoreceptor according to claim 2, wherein said light-sensitive layer is an assembly of a carrier generation layer and a carrier transporting layer.

15. A photoreceptor according to claim 3, wherein said light-sensitive layer is an assembly of a carrier generation layer and a carrier transporting layer.

16. A photoreceptor according to claim 2, wherein said light-sensitive layer has a carrier generating material dispersed in a carrier transporting layer.

17. A photoreceptor according to claim 3, wherein said light-sensitive layer has a carrier generating material dispersed in a carrier transporting layer.

18. A photoreceptor according to claim 2, wherein $R_1$ in formula (I) is an aryl group selected from the group consisting of a phenyl, naphthyl and anthryl group, or a heterocyclic group selected from the group consisting of a furyl, thienyl, indolyl, benzofuryl, benzothienyl and carbazolyl group, each of said aryl and heterocyclic groups being optionally substituted by a substituent selected from the group consisting of an alkyl group, an alkoxy group, a subsituted amino group selected from the group consisting of a dislkylamino, diarylamino and alkylarylamino group, a phenyl group, a naphthyl group, a hydroxyl group and a halogen atom.

19. A photoreceptor according to claim 3, wherein $R_1$ in formula (I) is an aryl group selected from the group consisting of a phenyl, naphthyl and anthryl group, or a heterocyclic group selected from the group consisting of a furyl, thienyl, indolyl, benzofuryl, benzothienyl and carbazolyl group, each of said aryl and heterocyclic groups being optionally substituted by a substituent selected from the group consisting of an alkyl group, an alkoxy group, a substituted amino group selected from the group consisting of a dislkylamino, diarylamino and alkylarylamino group, a phenyl group, a naphthyl group, a hydroxyl group and a halogen atom.

20. A photoreceptor according to claim 2, wherein $R_2$ in formula (I) is a hydrogen atom, an alkyl group, preferably having 1 to 8 carbon atoms, or an aryl group selected from the group consisting of a phenyl and naphthyl group, each of said alkyl and aryl groups being optionally substituted by a substituent selected from the group consisting of an alkyl group, an alkoxy group, a substituted amino group selected from the group consisting of a dialkylamino, diarylamino and alkylarylamino group, a hydroxyl group and a halogen atom.

21. A photoreceptor according to claim 3, wherein $R_2$ in formula (I) is a hydrogen atom, an alkyl group, preferably having 1 to 8 carbon atoms, or an aryl group selected from the group consisting of a phenyl and naphthyl group, each of said alkyl and aryl groups being optionally substituted by a substituent selected from the group consisting of an alkyl group, an alkoxy group, a substituted amino group selected from the group consisting of a dialkylamino, diarylamino and alkylarylamino group, a hydroxyl group and a halogen atom.

22. A photoreceptor according to claim 5, wherein one part by weight of said carrier transporting material is combined with 0.8 to 10 parts by weight of a binder.

23. A photoreceptor according to claim 12, wherein one part by weight of said carrier transporting material is combined with 0.8 to 10 parts by weight of a binder.

24. A photoreceptor according to claim 13, wherein one part by weight of said carrier transporting material is combined with 0.8 to 10 parts by weight of a binder.

25. A photoreceptor according to claim 14, wherein one part by weight of said carrier transporting material is combined with 0.8 to 10 parts by weight of a binder.

26. A photoreceptor according to claim 15, wherein one part by weight of said carrier transporting material is combined with 0.8 to 10 parts by weight of a binder.

27. A photoreceptor according to claim 16, wherein one part by weight of said carrier generating material is combined with not more than 5 parts by weight of a binder.

28. A photoreceptor according to claim 17, wherein one part by weight of said carrier generating material is combined with not more than 5 parts by weight of a binder.

29. A photoreceptor according to claim 14, wherein the carrier generation layer is positioned closes to the support than the carrier transporting layer is.

30. A photoreceptor according to claim 15, wherein the carrier generation layer is positioned closes to the support than the carrier transporting layer is.

* * * * *